US008746473B2

(12) United States Patent
Smerecky et al.

(10) Patent No.: US 8,746,473 B2
(45) Date of Patent: Jun. 10, 2014

(54) RAILWAY COUPLER BODY IMPROVEMENTS TO IMPROVE KNUCKLE ROTATION

(75) Inventors: Jerry R. Smerecky, Roselle, IL (US); Thomas A. Marchese, Schaumburg, IL (US); Eric W. Larson, Pecatonica, IL (US)

(73) Assignee: Bedloe Industries LLC, Wilmington, DE (US)

( * ) Notice: Subject to any disclaimer, the term of this patent is extended or adjusted under 35 U.S.C. 154(b) by 46 days.

(21) Appl. No.: 12/471,029

(22) Filed: May 22, 2009

(65) Prior Publication Data

US 2009/0289022 A1 Nov. 26, 2009

Related U.S. Application Data

(60) Provisional application No. 61/055,396, filed on May 22, 2008.

(51) Int. Cl.
*B61G 3/00* (2006.01)

(52) U.S. Cl.
USPC ..... 213/119

(58) Field of Classification Search
USPC ..... 213/100 R, 119–123, 139–144
See application file for complete search history.

(56) References Cited

U.S. PATENT DOCUMENTS

| | | | | |
|---|---|---|---|---|
| 450,947 A | | 4/1891 | Barnes | |
| 491,174 A | | 2/1893 | Hazlehurst et al. | |
| 892,563 A | | 7/1908 | Starbird | |
| 1,346,224 A | | 7/1920 | McCormick | |
| 1,382,530 A | | 6/1921 | Murphy | |
| 1,638,885 A | | 8/1927 | Shea | |
| 1,758,235 A | | 5/1930 | Nash | |
| 1,932,440 A | | 10/1933 | Bazeley | |
| 1,966,765 A | | 7/1934 | Murphy | |
| 2,039,086 A | | 4/1936 | Kinne | |
| 2,088,135 A | | 7/1937 | Johnson et al. | |
| 2,350,470 A | * | 6/1944 | Metzger | 213/146 |
| 2,617,540 A | | 11/1952 | Metzger | |
| 2,688,412 A | | 9/1954 | Kulieke | |
| 2,709,007 A | * | 5/1955 | Metzger | 213/146 |
| 2,760,652 A | | 8/1956 | Blattner | |
| 2,909,293 A | | 10/1959 | Metzger | |
| 2,948,414 A | * | 8/1960 | Metzger | 213/127 |
| 2,959,299 A | | 11/1960 | Metzger | |
| 3,121,498 A | | 2/1964 | Sudeck | |
| 3,168,202 A | | 2/1965 | Cope | |

(Continued)

FOREIGN PATENT DOCUMENTS

| | | |
|---|---|---|
| BE | 524450 A | 5/1954 |
| CA | 485408 A | 8/1952 |

(Continued)

OTHER PUBLICATIONS

Office Action for Chinese Application No. 200980122328.8, dated Sep. 23, 2013 (12 pages).

(Continued)

*Primary Examiner* — R. J. McCarry, Jr.
(74) *Attorney, Agent, or Firm* — Nathan O. Greene; Brinks Gilson & Lione

(57) ABSTRACT

An improved coupler body having an area of increased material in the upper lock chamber.

14 Claims, 8 Drawing Sheets

(56) References Cited

U.S. PATENT DOCUMENTS

| | | | | |
|---|---|---|---|---|
| 3,206,039 | A | 9/1965 | Metzger | |
| 3,572,518 | A | 3/1971 | Wisler | |
| 3,604,569 | A | 9/1971 | Kulieke | |
| 3,613,902 | A | 10/1971 | Altherr | |
| 3,627,145 | A | 12/1971 | Altherr | |
| 3,635,356 | A | 1/1972 | Shramovich | |
| 3,635,358 | A | 1/1972 | Altherr | |
| 3,637,089 | A | 1/1972 | Jwuc et al. | |
| 3,640,402 | A | 2/1972 | Altherr et al. | |
| 3,670,901 | A | 6/1972 | Metzger | |
| 3,675,787 | A | 7/1972 | Krauskopf | |
| 3,698,570 | A | 10/1972 | Metzger | |
| 3,698,571 | A | 10/1972 | Hawthorne | |
| 3,717,261 | A | 2/1973 | DePenti | |
| 3,722,708 | A | 3/1973 | Ion et al. | |
| 3,735,877 | A | 5/1973 | Bossong | |
| 3,767,062 | A | 10/1973 | Holibaugh | |
| 3,779,397 | A | 12/1973 | De Penti | |
| 3,833,131 | A | 9/1974 | Altherr | |
| 3,850,311 | A | 11/1974 | Kaufhold | |
| 3,850,312 | A | 11/1974 | Baker, Sr. | |
| 3,853,228 | A * | 12/1974 | Metzger | 213/146 |
| 3,854,599 | A | 12/1974 | Day et al. | |
| 3,856,154 | A | 12/1974 | DePenti | |
| 3,856,155 | A | 12/1974 | Altherr | |
| 3,856,156 | A | 12/1974 | Metzger | |
| 3,857,495 | A | 12/1974 | Kaufhold | |
| 3,858,729 | A | 1/1975 | Altherr | |
| 3,860,121 | A | 1/1975 | Snell | |
| 3,872,978 | A | 3/1975 | Altherr | |
| 3,881,602 | A | 5/1975 | Altherr et al. | |
| 3,923,164 | A | 12/1975 | Dalton | |
| 3,971,479 | A | 7/1976 | DePenti | |
| 3,972,421 | A | 8/1976 | DePenti | |
| RE29,011 | E | 10/1976 | Altherr | |
| 3,998,337 | A | 12/1976 | Altherr | |
| 4,024,958 | A | 5/1977 | Kaufhold | |
| 4,051,954 | A | 10/1977 | Roberts | |
| 4,064,998 | A | 12/1977 | Dilg et al. | |
| 4,081,082 | A | 3/1978 | Scherrer et al. | |
| 4,084,704 | A | 4/1978 | Metzger | |
| 4,084,705 | A * | 4/1978 | Oshinsky et al. | 213/127 |
| 4,090,614 | A | 5/1978 | Altherr et al. | |
| 4,090,615 | A | 5/1978 | Martin | |
| 4,093,079 | A | 6/1978 | Cope | |
| 4,119,209 | A | 10/1978 | Jwuc | |
| 4,129,219 | A | 12/1978 | Polanin | |
| 4,135,629 | A | 1/1979 | Dilg et al. | |
| 4,143,701 | A | 3/1979 | Oshinsky et al. | |
| 4,146,143 | A | 3/1979 | Schelle | |
| 4,172,530 | A | 10/1979 | Altherr et al. | |
| 4,206,849 | A | 6/1980 | Kaim | |
| 4,230,228 | A | 10/1980 | Kaim | |
| 4,245,747 | A | 1/1981 | Roberts | |
| 4,258,628 | A | 3/1981 | Altherr | |
| 4,267,935 | A | 5/1981 | Dilg | |
| 4,287,834 | A | 9/1981 | Zehnder et al. | |
| 4,316,549 | A | 2/1982 | Klimowicz | |
| 4,333,576 | A | 6/1982 | Kaim | |
| 4,363,414 | A | 12/1982 | Kaim | |
| 4,391,380 | A | 7/1983 | Hoose | |
| 4,398,641 | A | 8/1983 | Klimowicz | |
| 4,426,012 | A | 1/1984 | Adams, III et al. | |
| 4,438,854 | A | 3/1984 | Baughman et al. | |
| 4,438,855 | A | 3/1984 | Altherr | |
| 4,445,617 | A | 5/1984 | Elliott | |
| 4,452,299 | A | 6/1984 | Gruber et al. | |
| 4,466,546 | A | 8/1984 | Altherr et al. | |
| 4,474,732 | A | 10/1984 | Lynn | |
| 4,480,758 | A | 11/1984 | Hurt et al. | |
| 4,585,133 | A | 4/1986 | Cope | |
| 4,595,109 | A | 6/1986 | McClurg | |
| 4,605,133 | A | 8/1986 | Altherr | |
| 4,637,518 | A | 1/1987 | Hanula | |
| 4,640,422 | A | 2/1987 | Elliott | |
| 4,645,085 | A | 2/1987 | Hanula et al. | |
| 4,706,826 | A | 11/1987 | Elliott et al. | |
| 4,776,474 | A | 10/1988 | Terlecky et al. | |
| 4,811,854 | A | 3/1989 | Elliott | |
| 4,848,611 | A | 7/1989 | Terlecky et al. | |
| 4,927,035 | A | 5/1990 | Geng et al. | |
| 4,976,362 | A | 12/1990 | Kaufhold | |
| 4,976,363 | A | 12/1990 | Altherr | |
| 4,982,781 | A | 1/1991 | Carpenter et al. | |
| 4,984,696 | A | 1/1991 | Altherr | |
| 5,050,751 | A | 9/1991 | Thrift et al. | |
| 5,139,161 | A | 8/1992 | Long | |
| 5,145,076 | A | 9/1992 | Murphy et al. | |
| 5,285,911 | A | 2/1994 | Altherr | |
| 5,305,899 | A | 4/1994 | Kaufhold | |
| 5,312,007 | A | 5/1994 | Kaufhold et al. | |
| 5,415,304 | A | 5/1995 | Hanes et al. | |
| 5,424,376 | A | 6/1995 | Chang et al. | |
| 5,427,257 | A | 6/1995 | Hanes et al. | |
| 5,482,675 | A | 1/1996 | Shotwell et al. | |
| D369,756 | S | 5/1996 | Noel | |
| 5,582,307 | A | 12/1996 | Hawthorne et al. | |
| 5,630,519 | A | 5/1997 | Burke et al. | |
| 5,833,086 | A | 11/1998 | Kaufhold | |
| 5,878,897 | A | 3/1999 | Lazzaro et al. | |
| 5,927,522 | A | 7/1999 | Carifa | |
| 5,954,212 | A | 9/1999 | Beatty et al. | |
| 6,005,021 | A | 12/1999 | Chen et al. | |
| 6,062,406 | A | 5/2000 | Duncan | |
| 6,129,227 | A | 10/2000 | Openchowski et al. | |
| 6,148,733 | A | 11/2000 | Gagliardino | |
| 6,206,215 | B1 | 3/2001 | Maa | |
| 6,237,785 | B1 | 5/2001 | Daugherty, Jr. | |
| 6,360,906 | B1 | 3/2002 | Kaufhold et al. | |
| 6,446,820 | B1 | 9/2002 | Barker et al. | |
| 6,488,163 | B1 | 12/2002 | Wurzer et al. | |
| 6,681,943 | B2 | 1/2004 | Barker et al. | |
| 6,758,919 | B2 | 7/2004 | Milligan | |
| 6,783,610 | B2 | 8/2004 | Shirley et al. | |
| 6,796,448 | B1 | 9/2004 | Wilt et al. | |
| 6,944,925 | B2 | 9/2005 | Brueckert et al. | |
| 7,020,977 | B2 | 4/2006 | Brueckert et al. | |
| 7,059,062 | B2 | 6/2006 | Brueckert et al. | |
| 7,143,522 | B2 | 12/2006 | Brueckert et al. | |
| 7,171,734 | B2 | 2/2007 | Brueckert et al. | |
| 7,171,758 | B2 | 2/2007 | Brueckert et al. | |
| 7,302,994 | B2 | 12/2007 | Mautino et al. | |
| 7,337,826 | B2 | 3/2008 | Mautino et al. | |
| 7,360,318 | B2 | 4/2008 | Brueckert et al. | |
| 2003/0127412 | A1 | 7/2003 | Mautino et al. | |
| 2004/0173555 | A1 | 9/2004 | Wilt et al. | |
| 2005/0160581 | A1 | 7/2005 | Brueckert et al. | |
| 2005/0160582 | A1 | 7/2005 | Brueckert et al. | |
| 2005/0160584 | A1 | 7/2005 | Brueckert et al. | |
| 2005/0184021 | A1 | 8/2005 | Mautino et al. | |
| 2006/0113267 | A1 | 6/2006 | Mautino et al. | |
| 2007/0084818 | A1 | 4/2007 | Brabb et al. | |
| 2007/0125510 | A1 | 6/2007 | Mautino et al. | |
| 2007/0130773 | A1 | 6/2007 | Brueckert et al. | |
| 2008/0083690 | A1 | 4/2008 | Mautino et al. | |

FOREIGN PATENT DOCUMENTS

| | | | |
|---|---|---|---|
| CA | 510469 | A | 3/1955 |
| CA | 753964 | A | 3/1957 |
| CA | 540837 | A | 5/1957 |
| CA | 547137 | A | 10/1957 |
| CA | 905353 | A | 7/1972 |
| CA | 1022116 | A1 | 12/1977 |
| CA | 1034085 | A1 | 7/1978 |
| CA | 1039683 | A1 | 10/1978 |
| CA | 1041050 | A1 | 10/1978 |
| CA | 1045085 | A1 | 12/1978 |
| CA | 1079234 | A1 | 6/1980 |
| CA | 1087135 | A1 | 10/1980 |
| CA | 1089808 | A1 | 11/1980 |
| CA | 1093021 | A1 | 1/1981 |
| CA | 1098869 | A1 | 4/1981 |
| CA | 1108560 | A1 | 9/1981 |

(56) References Cited

FOREIGN PATENT DOCUMENTS

| | | | |
|---|---|---|---|
| CA | 1195660 | A1 | 10/1985 |
| CA | 1226244 | A1 | 9/1987 |
| CA | 1251170 | A1 | 3/1989 |
| CA | 2027987 | A1 | 5/1991 |
| CA | 2054390 | A1 | 5/1992 |
| CA | 2171030 | A1 | 11/1996 |
| CA | 2260658 | A1 | 9/1999 |
| CA | 2395875 | A1 | 7/2003 |
| CA | 2573306 | A1 | 2/2006 |
| CN | 101010231 | A | 8/2007 |
| EP | 1531018 | A1 | 5/2005 |
| GB | 185657 | A | 9/1922 |
| GB | 221691 | A | 9/1924 |
| GB | 326575 | A | 3/1930 |
| GB | 355247 | A | 8/1931 |
| GB | 743098 | A | 1/1956 |
| GB | 902971 | A | 8/1962 |
| GB | 1477368 | A | 6/1977 |
| GB | 2300611 | A | 11/1996 |
| WO | WO 01/81024 | A1 | 11/2001 |
| WO | WO 2006/017412 | A1 | 2/2006 |
| WO | WO 2009/142746 | A1 | 11/2009 |
| WO | WO 2009/142747 | A1 | 11/2009 |
| WO | WO 2009/142748 | A1 | 11/2009 |
| WO | WO 2009/142749 | A1 | 11/2009 |
| WO | WO 2009/142750 | A1 | 11/2009 |
| WO | WO 2009/142757 | A1 | 11/2009 |
| WO | WO 2011/084992 | A1 | 7/2011 |

OTHER PUBLICATIONS

Translation of Office Action for corresponding Mexican Application No. MX/A/2010/012719, dated Aug. 15, 2013 (5 pages).
Transactions of the American Foundrymen's Society, Proceedings of the Ninety-first Annual Meeting, Apr. 5-10, 1987. vol. 95, 21 pages.
Unknown Author, "A.R.A. Type "E" Coupler," Railway Mechanical Engineer, May 1932, pp. 207-208.
Unknown Author, "Report on Couplers and Draft Gears," Railway Mechanical Engineer, Jul. 1933, pp. 243-244.
Unknown Author, "Steel Castings Handbook," 6$^{th}$ Edition, Steel Founders' Society of America, © 1995, 3 pages.
Walton, Charles F. et al., "Iron Castings Handbook," Iron Castings Society, Inc., © 1981, 5 pages.
Office Action from co-pending U.S. Appl. No. 12/470,915, dated Feb. 16, 2011, 8 pages.
Office Action from co-pending U.S. Appl. No. 12/470,883, dated Mar. 2, 2011, 8 pages.
Office Action from co-pending U.S. Appl. No. 12/471,110, dated Mar. 17, 2011, 11 pages.
Office Action from co-pending U.S. Appl. No. 12/471,053, dated Mar. 21, 2011, 12 pages.
Office Action from co-pending U.S. Appl. No. 12/471,136, dated Jun. 21, 2011, 9 pages.
Office Action from co-pending U.S. Appl. No. 12/685,346, dated Aug. 16, 2011, 7 pages.
Office Action from co-pending U.S. Appl. No. 12/470,883, dated Sep. 21, 2011, 8 pages.
U.S. Appl. No. 12/470,883, filed May 22, 2009.
U.S. Appl. No. 12/470,915, filed May 22, 2009.
U.S. Appl. No. 12/471,053, filed May 22, 2009.
U.S. Appl. No. 12/471,110, filed May 22, 2009.
U.S. Appl. No. 12/471,136, filed May 22, 2009.
U.S. Appl. No. 12/685,346, filed May 22, 2009.
International Search Report for International Application No. PCT/US2009/003154, dated Sep. 3, 2009, 3 pages.
International Preliminary Report on Patentability for International Application No. PCT/US2009/003154, dated Nov. 23, 2010, 8 pages.
International Search Report for International Application No. PCT/US2009/003155, dated Aug. 27, 2009, 3 pages.
International Preliminary Report on Patentability for International Application No. PCT/US2009/003155, dated Nov. 23, 2010, 7 pages.
International Search Report for International Application No. PCT/US2009/003157, dated Sep. 10, 2009, 3 pages.
International Preliminary Report on Patentability for International Application No. PCT/US2009/003157, dated Nov. 23, 2010, 8 pages.
International Search Report for International Application No. PCT/US2009/003158, dated Aug. 27, 2009, 2 pages.
International Preliminary Report on Patentability for International Application No. PCT/US2009/003158, dated Nov. 23, 2010, 9 pages.
International Search Report for International Application No. PCT/US2009/003159, dated Aug. 31, 2009, 3 pages.
International Preliminary Report on Patentability for International Application No. PCT/US2009/003159, dated Nov. 23, 2010, 8 pages.
International Search Report for International Application No. PCT/US2009/003170, dated Sep. 1, 2009, 3 pages.
International Preliminary Report on Patentability for International Application No. PCT/US2009/003170, dated Nov. 23, 2010, 9 pages.
International Search Report for International Application No. PCT/US2011/020207, dated Apr. 15, 2011, 2 pages.
Armstrong Mold Corporation, "Precision Air-Set Sand Casting Process," retrieved Oct. 7, 2009, from http://www.armstrongmold.com/pages/airset.html, 2 pages.
Bernier Cast Metals Inc., "Air-Set (No Bake) Process," retrieved Oct. 7, 2009, from http://www.bernierinc.com/AirSet.html, 1 page.
Bernier Cast Metals Inc., "Green Sand Molding," retrieved Oct. 7, 2009, from http://www.bernierinc.com/GreenSandMolding.html, 1 page.
Butler Foundry, "Air Set Casting," retrieved Oct. 7, 2009, from http://www.foundrycasting.co.uk/air-set-casting.html, 2 pages.
CUSTOM PartNet, "Sand Casting," retrieved Oct. 7, 2009, from http://www.custompartnet.com/wu/SandCasting, 7 pages.
Scrata Specifications Committee, "Comparators for the Definition of Surface Quality of Steel Castings," publication date unknown, 32 pages.
SFSA Supplement 3, "Dimensional Capabilities of Steel Castings," retrieved Jan. 12, 2010, from www.sfsa.org/sfsa/pubs/hbk/s3.pdf, 33 pages.
Wikipedia, "Chill (casting)," retrieved Oct. 7, 2009, from http://en,wikipedia.org/wiki/Chill_(foundry), 2 pages.
Wikipedia, "Cope and drag," retrieved Oct. 7, 2009, from http://en.wikipedia.org/wiki/Cope_and_drag, 1 page.
Wikipedia, "Flask (casting)," retrieved Oct. 7, 2009, from http://en.wikipedia.org/wiki/Casting_flask, 1 page.
Wikipedia, "Molding sand," retrieved Oct. 7, 2009, from http://en.wikipedia.org/wiki/Molding_sand, 1 page.
Wikipedia, "No bake mold casting," retrieved Oct. 7, 2009, from http://en.wikipedia.org/wiki/No_bake_mold_casting, 2 pages.
Wikipedia, "Sand Casting," retrieved Oct. 7, 2009, from http://en.wikipedia.org/wiki/Sand_casting, 10 pages.
Office Action for Chinese Patent Application No. 200980122328.8, dated Feb. 25, 2013 (8 pages).

* cited by examiner

RAILWAY COUPLER BODY IMPROVEMENTS TO IMPROVE KNUCKLE ROTATION

RELATED APPLICATIONS

This application claims priority to U.S. provisional application Ser. No. 61/055,396 filed May 23, 2008, the disclosure of which is incorporated by reference herein in its entirety.

FIELD OF INVENTION

The present invention relates generally to the field of railroad couplers, and more specifically to the coupler body and improvements therein that assist in determining the lock's relative position in lock set and thereby improve knuckle rotation.

BACKGROUND

The coupler assemblies on railcars sometimes do not operate properly in lock set. When the coupler is in the lock set position, the couplers are still engaged, but pulling forces between the railcars allows them to be pulled apart. The knuckle of the coupler may jam against the lock, preventing proper knuckle rotation. In some cases, may be as much as 50% of the time, knuckle and lock interference occurs in lock set, requiring the user to lift and hold the uncoupling lever in its most raised position to facilitate uncoupling. The traditional focus when addressing lock set jamming concerns between the knuckle and lock was on the lock and its interface with the thrower.

The options for addressing these problems are limited if the focus is only on the locations addressed in previous patents, such as U.S. Pat. Nos. 2,350,470; 2,709,007; 3,850,312; 4,084,705 and 4,363,414, all of which are herein incorporated by reference in their entirety. The options are also limiting when the focus is only on the mating parts of the system.

Other complications when attempting to solve this problem include the inability to completely measure (scan) to a very accurate level (+/−0.001") all the surfaces of each component (either theoretically or from actual production parts), create a very accurate CAD model (+/−0.001") of each part, and then create a working assembly of the system. Furthermore, the designer may not have the ability to use that model to investigate the issues, and to model and then simulate the proposed design changes to the model. In the past, the companies with the design engineering talents were either not interested in, or unable to undertake the time, provide the necessary engineering resources and/or spend the money necessary to investigate the concerns to the detail necessary to identify the concern, and then design a fix to these concerns. Modern day computer software and hardware is now available (at an attainable cost) and provide the tools necessary so that those that are experts in the field can use these tools to solve the problems that were here-to-for unsolvable.

There is a need to improve knuckle rotation to eliminate such jamming without delineating significantly from the accepted coupler assembly.

BRIEF SUMMARY

In a first embodiment, an improved coupler body having an area of increased material in the upper lock chamber is provided.

In a second embodiment, an improved coupler body including an area of increased material on the front face of the upper lock chamber of the coupler body is provided.

In a third embodiment, method of improving a lock's position in lock set in a coupler body of a railcar coupler, comprising the steps of providing a coupler body and adding material to the front face of the upper lock chamber of the coupler body is provided.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like-referenced numerals designate corresponding parts throughout the different views.

DETAILED DESCRIPTION OF THE DRAWINGS AND THE PRESENTLY PREFERRED EMBODIMENTS

The intent of the present invention is to improve knuckle rotation from lock set. This is accomplished by maximizing or adding material to the front of the upper lock chamber. The relative height of the thrower support surface of the coupler body can also be increased or maximized. These changes, alone or in combination, can influence the relative position of the lock in lock set.

Figure 1:
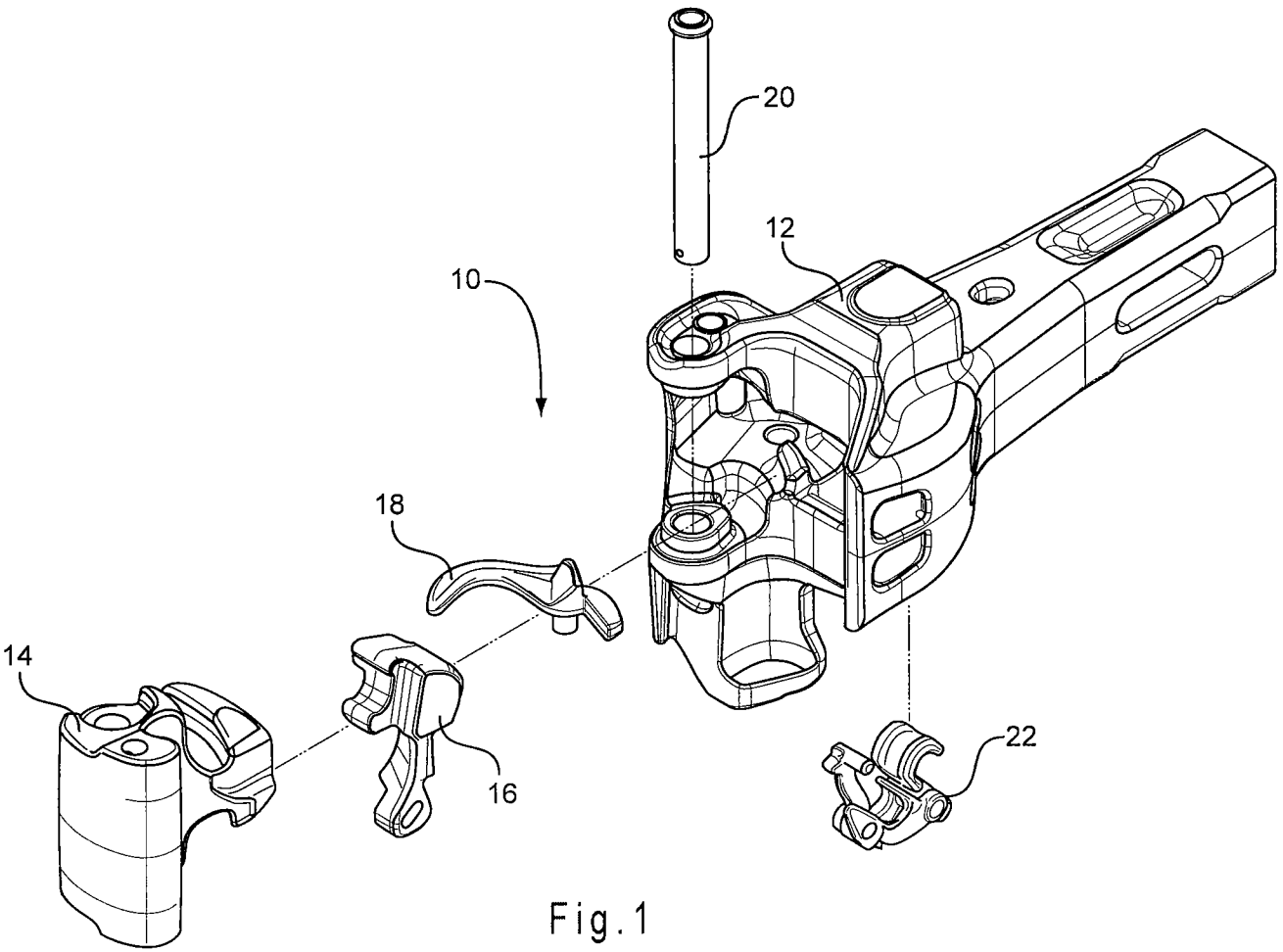
FIG. 1 is a perspective view of an exploded railroad coupler.
Figure 2:
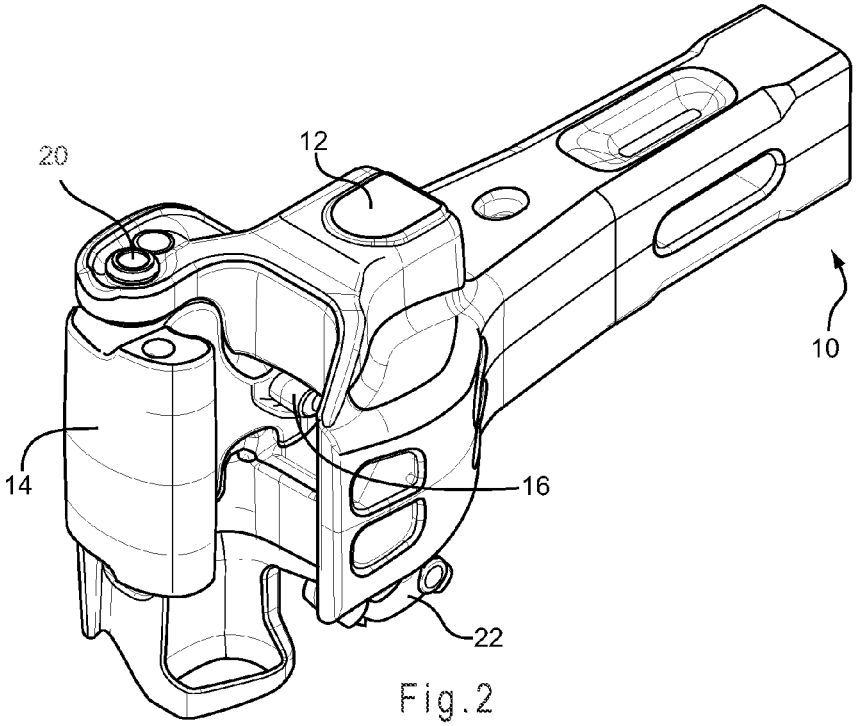
FIG. 2 is a perspective view of the coupler of FIG. 1 in an assembled configuration.
Figure 3A:
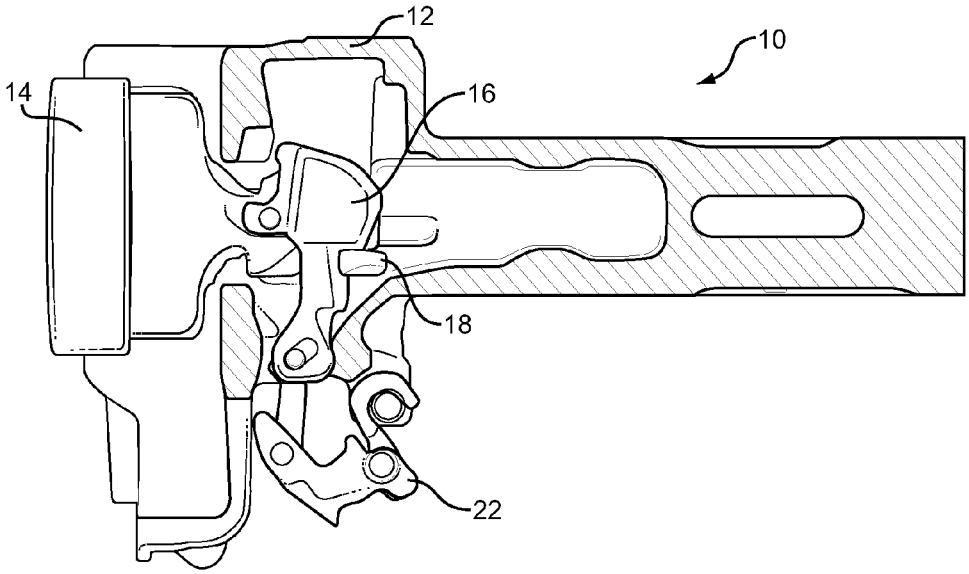
FIG. 3*a* is a cross-sectional view of the side of the coupler of FIG. 1 in the locked position.
Figure 3B:
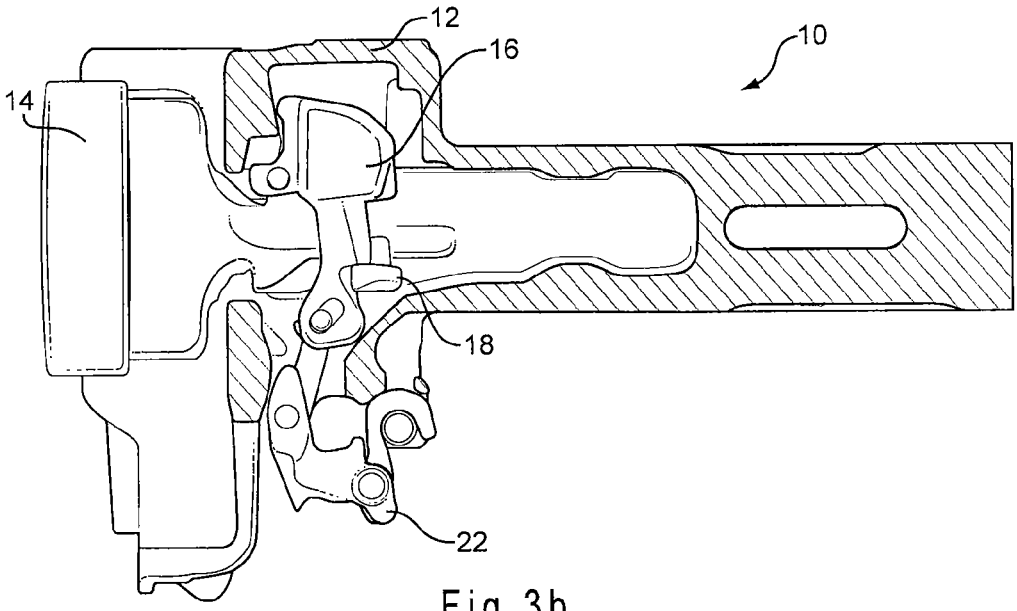
FIG. 3*b* is a cross-sectional view of the side of the coupler of FIG. 1 in the lock-set position.
Figure 3C:
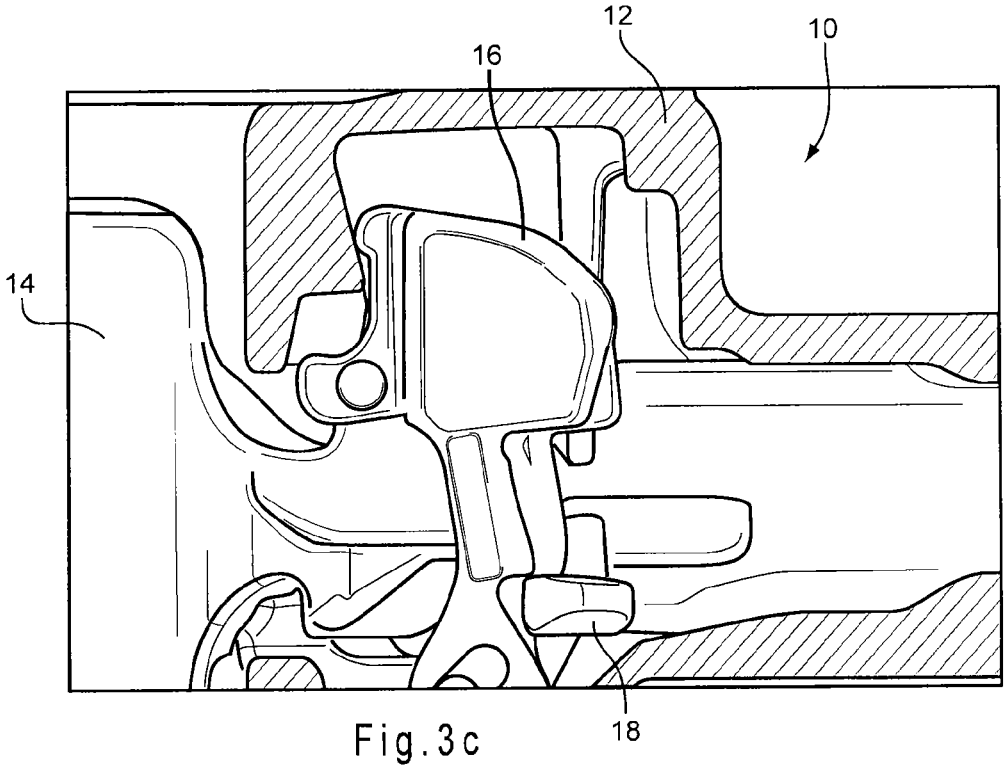
FIG. 3*c* is a close up cross-sectional view of the coupler of FIG. 1 in the lock-set position.
Figure 3D:
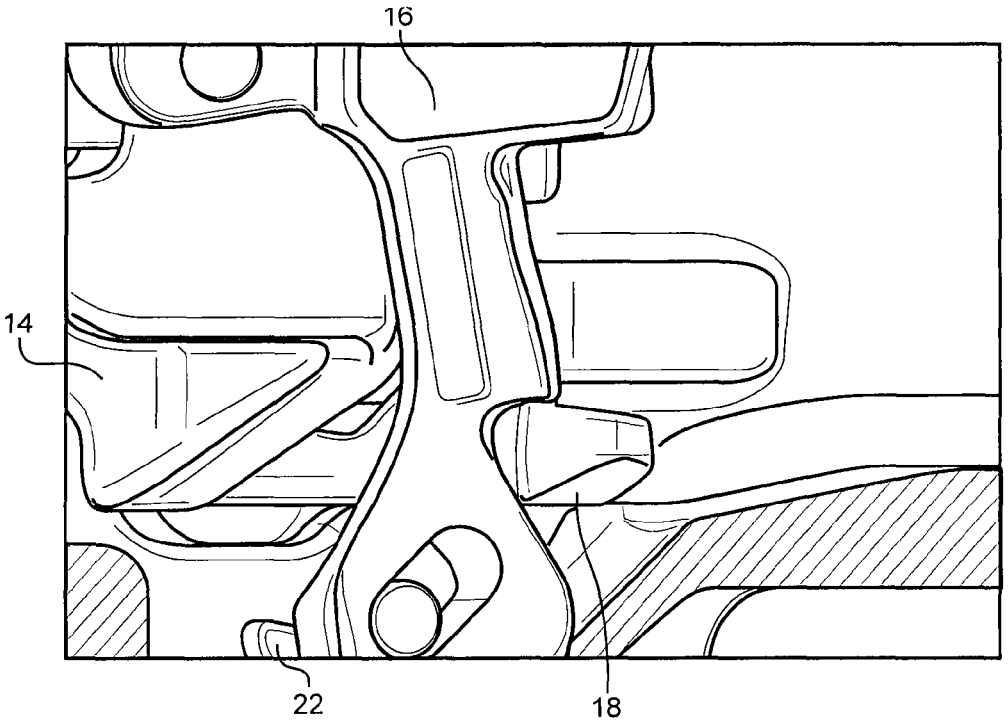
FIG. 3*d* is a close up cross-sectional view of the coupler of FIG. 1 in the lock-set position.
Figure 3E:
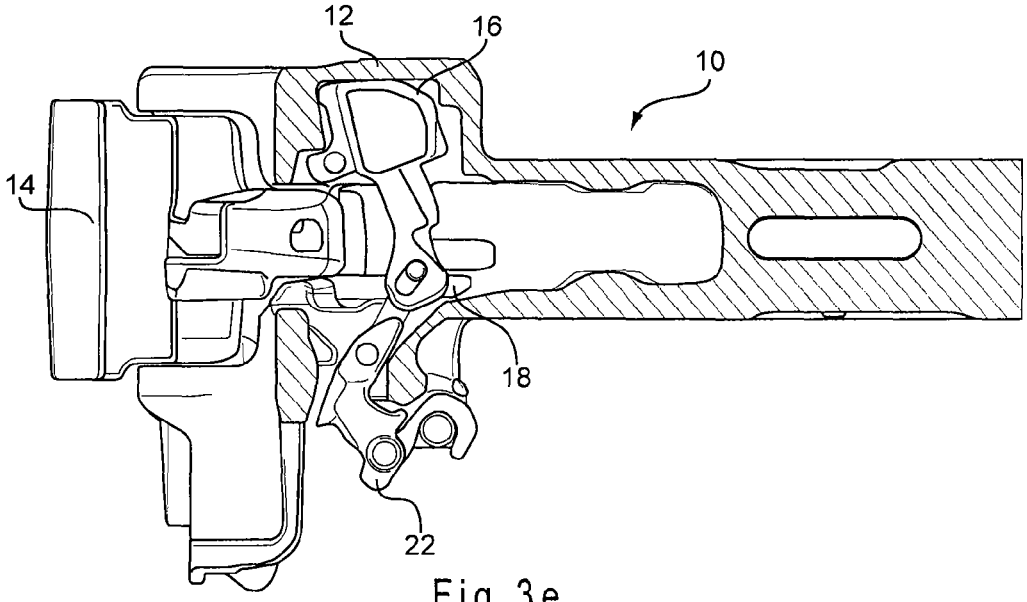
FIG. 3*e* is a cross-sectional view of the coupler of FIG. 1 in the unlocked position.

FIG. 1 shows an exploded coupler 10 in order to put the present invention in context and FIG. 2 shows the same coupler 10 in an assembled configuration. The body 12, knuckle 14, lock 16, thrower 18, pivot pin 20, and lock lift assembly 22 are shown. FIGS. 3*a*-3*e* illustrate the lock 16 in the "lock", "lock set" or "unlocked" configurations for reference. In FIG. 3*e*, the lock 16 is in the unlocked configuration. In FIGS. 3*b*, 3*c*, and 3*d*, the lock 16 is in the lock set position and in FIG. 3*a*, the lock 16 is in the locked position.

Figure 4:
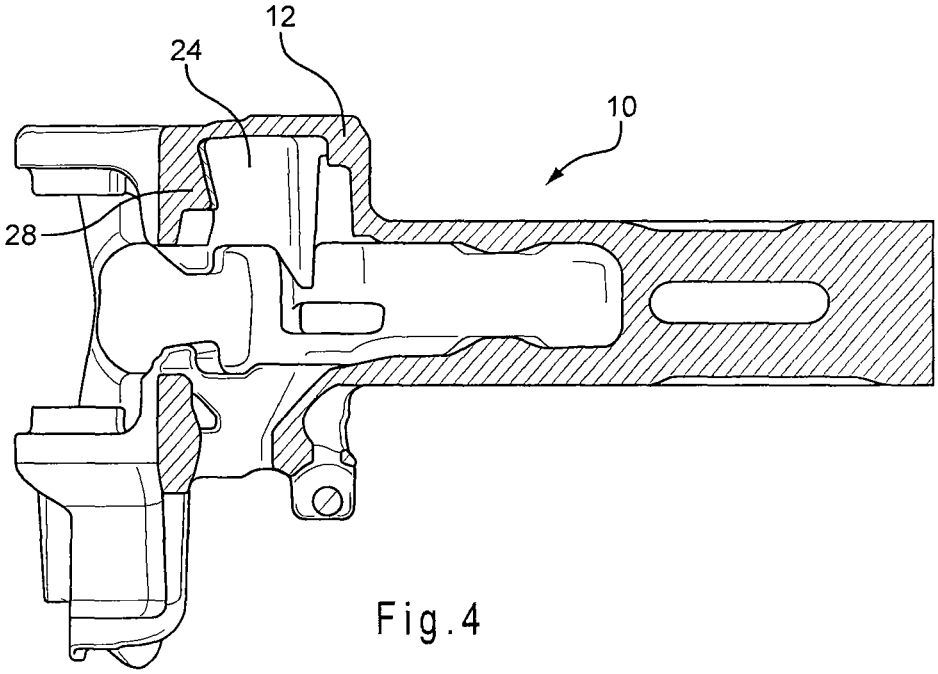
FIG. 4 is a cross-sectional view of the coupler of FIG. 1 with the knuckle and lock mechanism removed.
Figure 5A:
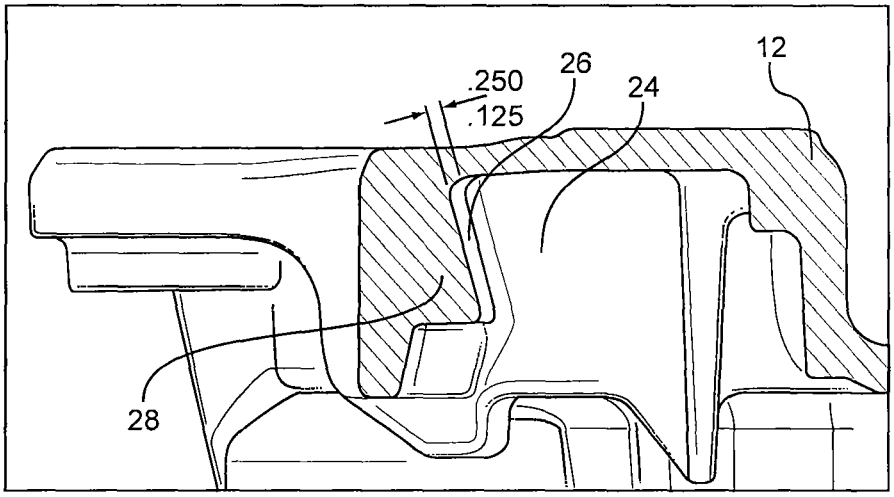
FIG. 5*a* is a close up view of the upper lock chamber of FIG. 4.
Figure 5B:
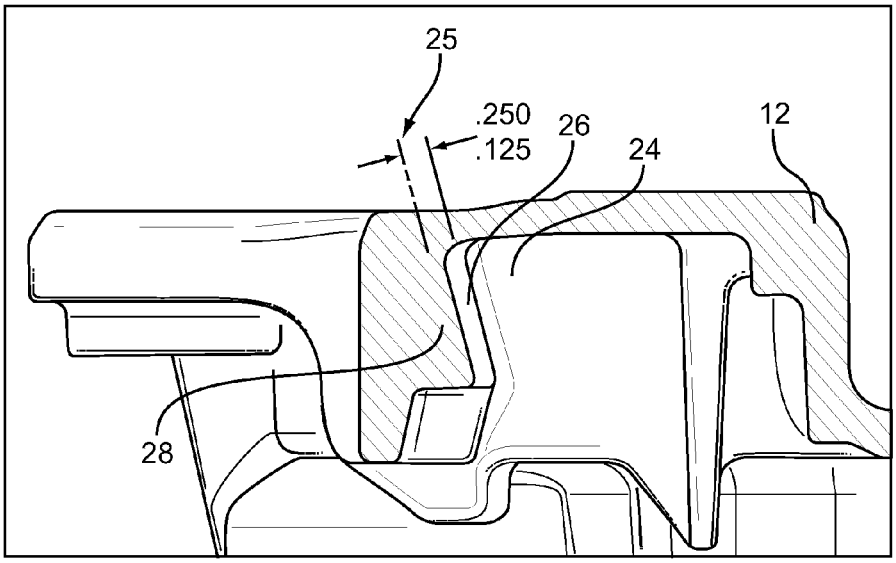
FIG. 5*b* is a close of view of the upper lock chamber of FIG. 4 comparing a prior art upper lock chamber.

FIG. 4 illustrates the entire coupler with the knuckle 12 and locking mechanism removed, and FIGS. 5*a* and 5*b* focus on the upper lock chamber 24 where the material 26 is added. As illustrated in FIG. 5*a*, additional material 26 is added to the front face 28 of the upper lock chamber 24. Preferably, the amount of material added to the front face 28 of the upper lock chamber 24 can vary from about 0.125" up to about 0.25". The material can be added in the form of ribs, pads or by adding material to the entire surface.

FIG. 5*b* shows a comparison between the front face 28 of a prior art lock chamber 24 compared to the lock chamber 24 of the present invention having additional material 26 on the front face 28. The dashed line 25 to the left of the shaded area in FIG. 5*b* represents the position of the prior art front face 28 of the lock chamber 24 and the shaded area represents the additional material 26 on the front face 28 of the present invention's lock chamber 24.

Figure 6A:
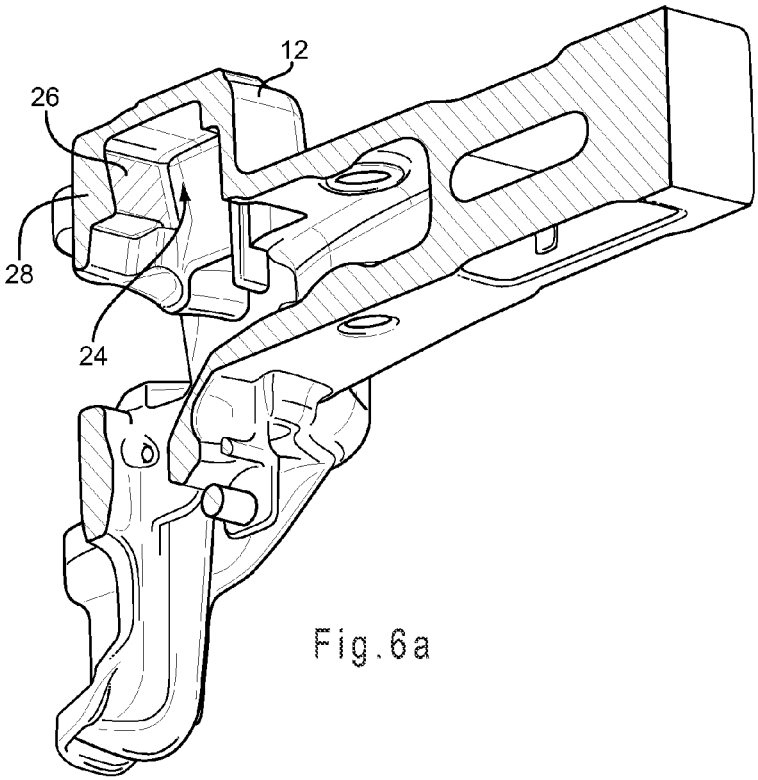
FIG. 6*a* is a perspective view of a cross section of half of the coupler of FIG. 4.
Figure 6B:
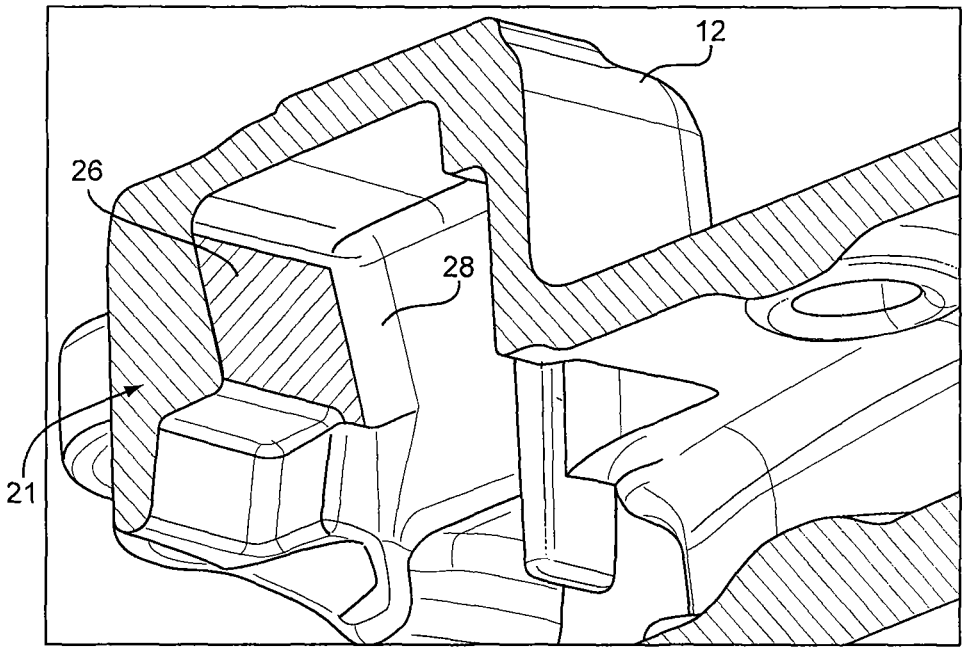
FIG. 6*b* is a close up perspective view of the upper lock chamber in FIG. 6*a*.

Referring to FIG. 6*a*, a cross section of a coupler body 10 of the present invention is shown. This alternative view shows the area where additional material 26 is added to the front face 28 of the upper lock chamber 24. FIG. 6*b* is a close up view of the same area. This additional thickness on the upper lock chamber 24 assists in positioning the head of the lock 16 further back so that it sits better on the thrower 18.

Figure 7A:
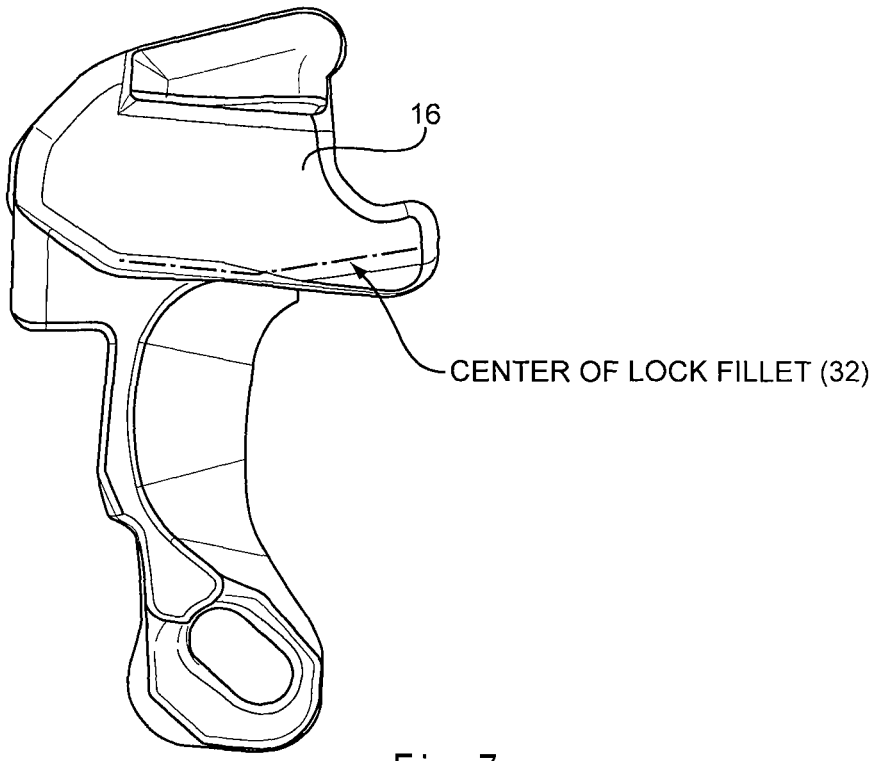
FIG. 7*a* is a side view of a lock.
Figure 7B:
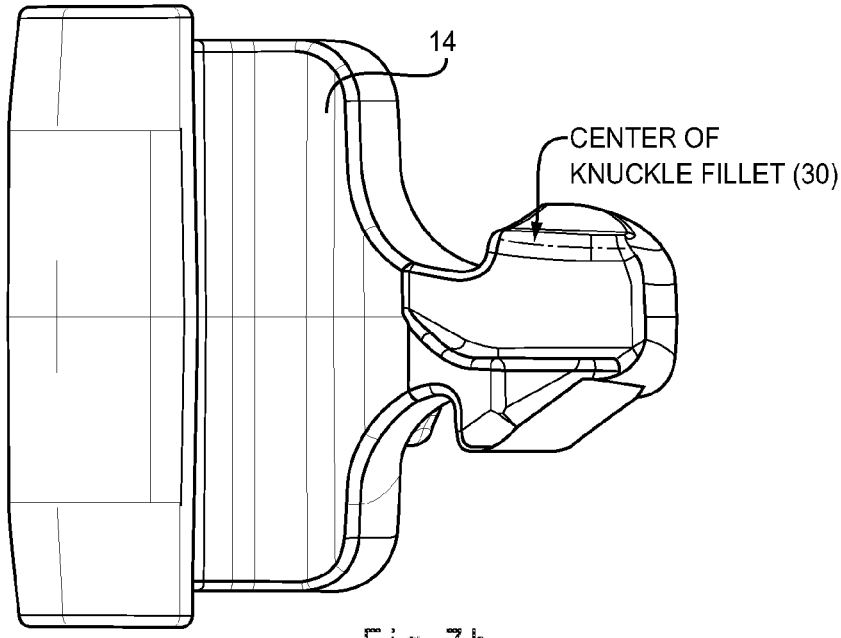
FIG. 7*b* is a side view of a knuckle.
Figure 7C:
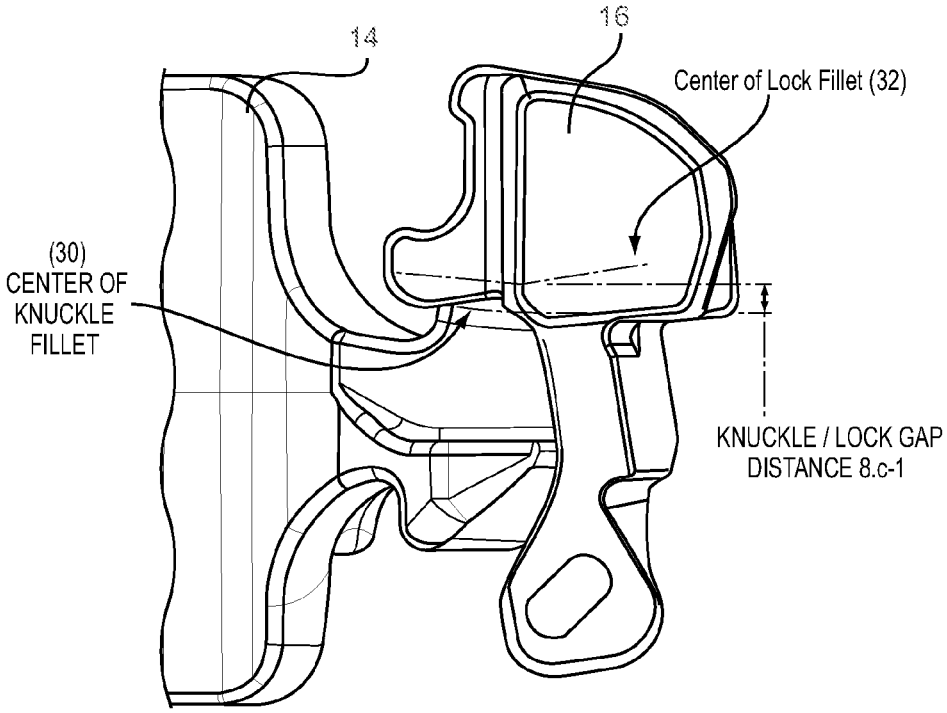
FIG. 7*c* shows the interface between the lock and the knuckle.

The amount of material 26 added to the front face 28 of the upper lock chamber 24 can vary from about 0.125" up to about 0.25". The material 26 can be added in the form of ribs, pads or by adding material to the entire surface. If the lock 16 and the knuckle 14 are not positioned correctly the features that form the center of knuckle fillet 30 and the center of lock fillet 32 as illustrated in FIGS. 7*a* to 7*c* will interfere. The interference of these fillets 30, 32 will cause the knuckle 14 to jam which will prevent the coupler assembly 10 from functioning properly.

The invention considers the entire system, rather than just the lock 16 and thrower 18. Through the use of Computer Aided Design (CAD) techniques each part is modeled and their operation is reviewed as a complete system. Previously, the interaction may have been prototyped with actual parts, and then all the different permeations and different combination of each variable were prototyped. This made the analysis of more than two features relative to each other, very labor intensive, very time consuming, and very expensive to compete. Additionally, if the solution relies on one of the removable parts (i.e. the lock 16 or thrower 18), when the part is removed from the body, the fix is also removed. The present invention provides a solution located on the coupler body 10, the part that usually lasts the longest and is replaced the least often.

It should be noted that a wide range of changes could be made to the present embodiments without departing from the scope of the claimed invention. More or less material could be added to the designated areas. The areas could also vary as long as the material did not cause further interference with the rotation of the coupler knuckle or any other coupler components.

It is therefore intended that the foregoing detailed description be regarded as illustrative rather than limiting, and that it be understood that it is the following claims, including all equivalents, that are intended to define the spirit and scope of this invention.

The invention claimed is:

1. An improved coupler body for a railroad coupler, the coupler body comprising:

a lower lock chamber having a first dimension from a first front face to an axis running vertically through a pivot point of a thrower; and an upper lock chamber having a second dimension from a second front face to the vertical axis, the second dimension being narrower than the first dimension, the upper lock chamber having an area of increased material added to the entirety of the second front face of the upper lock chamber to further narrow the second dimension.

2. The improved coupler body of claim 1, wherein the area of increased material positions a head of a lock further back to sit more completely on the thrower positionable within the coupler body, to thereby improve knuckle rotation from a lock set position.

3. The improved coupler body of claim 1, wherein the area of increased material comprises up to about 0.25" of material.

4. The improved coupler body of claim 1, wherein the area of increased material comprises at least about 0.125" of material.

5. The improved coupler body of claim 1, wherein the area of increased material comprises a pad.

6. The improved coupler body of claim 1, wherein the area of increased material comprises additional welded-on material.

7. An improved coupler body for a railroad coupler, the coupler body comprising:

a lower lock chamber having a first dimension from a first front face to an axis running vertically through a pivot point of a thrower; and an upper lock chamber having a second dimension from a second front face to the vertical axis, the second dimension being narrower than the first dimension, the upper lock chamber having an area of increased material on the entirety of the second front face to further narrow the second dimension, wherein the area of increased material positions a head of a lock further back to sit more completely on the thrower positionable within the coupler body, to thereby improve knuckle rotation from a lock set position.

8. The coupler body of claim 7, wherein the area of increased material comprises between about 0.125" and 0.25" of material added to the second front face of the upper lock chamber.

9. The coupler body of claim 7, wherein the area of increased material comprises a pad.

10. The coupler body of claim 7, wherein the area of increased material comprises welded-on material.

11. A method of improving a position of a lock in lock set in a coupler body of a railcar coupler, the method comprising the steps of:

providing a coupler body having a lower lock chamber having a first dimension from a first front face to an axis running vertically through a pivot point of a thrower, and having an upper lock chamber from a second front face to the vertical axis; and adding material to the entirety of the front face of the upper lock chamber of the coupler body to further narrow the second dimension.

12. The method of claim 11, wherein between about 0.125" and 0.25" of material is added to the front face of the upper lock chamber.

13. The method of claim 12, wherein the material comprises a pad.

14. The method of claim 12, wherein the material comprises welded-on material.

* * * * *